US007137441B2

(12) United States Patent
Hsu

(10) Patent No.: US 7,137,441 B2
(45) Date of Patent: Nov. 21, 2006

(54) END SURFACE CAPILLARY STRUCTURE OF HEAT PIPE

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/799,654

(22) Filed: Mar. 15, 2004

(65) Prior Publication Data

US 2005/0199374 A1 Sep. 15, 2005

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.21, 165/104.26, 104.33, 907; 257/715; 361/700; 174/15.2; 29/890.032
See application file for complete search history.

(56) References Cited

U.S. PATENT DOCUMENTS 3,754,594 A * 8/1973 Ferrell ..... 165/272
3,789,920 A * 2/1974 Low et al. ..... 165/104.26
4,196,504 A * 4/1980 Eastman ..... 29/890.032
4,254,821 A * 3/1981 Matsuda et al. ..... 165/41
4,565,243 A * 1/1986 Ernst et al. ..... 165/104.26
5,002,122 A * 3/1991 Sarraf et al. ..... 165/104.26
6,793,009 B1 * 9/2004 Sarraf ..... 165/104.33
6,907,918 B1 * 6/2005 Connors et al. ..... 165/104.26
2003/0066628 A1 * 4/2003 Mochizuki et al. .... 165/104.26
2003/0141045 A1 * 7/2003 Oh et al. ..... 165/104.26

* cited by examiner

*Primary Examiner*—Tho Duong

(57) ABSTRACT

An end-surface wick structure of a heat pipe provided by the present invention has a pipe member and a wick structure. The wick structure has at least one woven mesh to be attached to an internal sidewall of the pipe member and one sintering powder attached to an internal surface of a bottom lid covering a bottom end of the pipe member. Thereby, the sintering powder can be attached to bottom corners of the pipe member to improve heat transfer and conduction of the heat pipe.

10 Claims, 7 Drawing Sheets

END SURFACE CAPILLARY STRUCTURE OF HEAT PIPE

BACKGROUND OF THE INVENTION

The present invention relates in general to an end surface capillary structure of a heat pipe, and more particularly, to a heat pipe that includes end surfaces in contact with heat source to dissipate heat and a wick structure fabricated by power sintering and mesh woven.

Having the characteristics of high thermal conductivity, fast thermal conduction, light weight, non-movable components and simple structure, heat pipes are able to deliver large amount of heat without consuming electricity, and are therefore commonly used in the market.

FIG. 1 illustrates a conventional heat pipe 1*a* that includes a pipe member 10*a* and a powder-sintered wick structure 11*a* attached to an internal sidewall of the pipe member 10*a*. The wick structure 11*a* provides capillary force to transport working fluid filled in the pipe member 1*a*. However, the fabrication of the wick structure 11*a* requires an axial bar 12*a* inserted into the heat pipe 1*a* for supporting the wick structure 11*a* during powder sintering process to avoid powder collapse. This type of wick structure has the following drawbacks.

1. When the axial bar 12*a* is inserted into the pipe member 10*a* of the heat pipe 1*a*, it is difficult to dispose the axial bar 1*a* along the axis of the pipe member 10*a*. Instead, the axial bar 1*a* is easily deviated from the axis to cause non-uniform wick structure 11*a*, such that the fluid transportation is non-uniform to cause poor thermal conduction.

2. After powder sintering process, the powder for forming the wick structure 11*a* is easily attached to the axial bar 12*a* to cause problem for removing the axial bar 12*a* from the pipe member 10*a*. Therefore, the quality of such heat pipe depends on proficiency of the operator, and it cannot be fabricated by mass production.

3. As it is difficult to remove the axial bar 12*a*, external force is required for the removal. However, because an annealing process the wick structure 11*a* and the pipe member 10*a* are before being removed, the heat pipe 1*a* is extremely soft during the removal process. Therefore, the heat pipe 10*a* is easily deformed, the wick structure is easily damaged, and the dimension precision will be greatly affected.

FIG. 2 illustrates a cross sectional view of another conventional heat pipe 2*a*. The wick structure 21*a* attached to an internal wall of the pipe member 20*a* of the heat pipe 2*a* is fabricated by mesh weaving. The mesh woven wick structure 21*a* is easily bent and curled before being disposed into the pipe member 20*a*. Therefore, the woven mesh cannot be properly adhered to the interior bottom corners A to cause incomplete capillary transfer. That is, the capillary force is relatively weak, delivery of the working fluid is slower, and the heat conduction performance is poorer. If one forces the woven mesh completely attached to the internal surface at the bottom corners, the structure of the woven mesh will be discontinuous because of deformation and pressure to cause poor delivery of working fluid.

Therefore, there exist inconvenience and drawbacks for practically application of the above-mentioned conventional heat pipe. There is thus a substantial need to provide an improved end surface capillary structure of a heat pipe that resolves the above drawbacks and can be used more conveniently and practically.

SUMMARY OF THE INVENTION

The present invention provides a heat pipe having an end surface capillary structure serving as a heat absorption portion. The capillary structure combines the powder sintering process and the mesh weaving process. Therefore, the drawback mesh weaving process is resolved, while the capillary structure of the heat pipe provides proper delivery of working fluid.

The end-surface wick structure of a heat pipe provided by the present invention includes a pipe member and a wick structure. The wick structure includes at least one woven mesh to be attached to an internal sidewall of the pipe member and one sintering powder attached to an internal surface of a bottom lid covering a bottom end of the pipe member. Thereby, the sintering powder can be attached to bottom corners of the pipe member to improve heat transfer and conduction of the heat pipe.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF ACCOMPANIED DRAWINGS

The above objects and advantages of the present invention will be become more apparent by describing in detail exemplary embodiments thereof with reference to the attached drawings in which.

DETAILED DESCRIPTION OF EMBODIMENT

Figure 1:
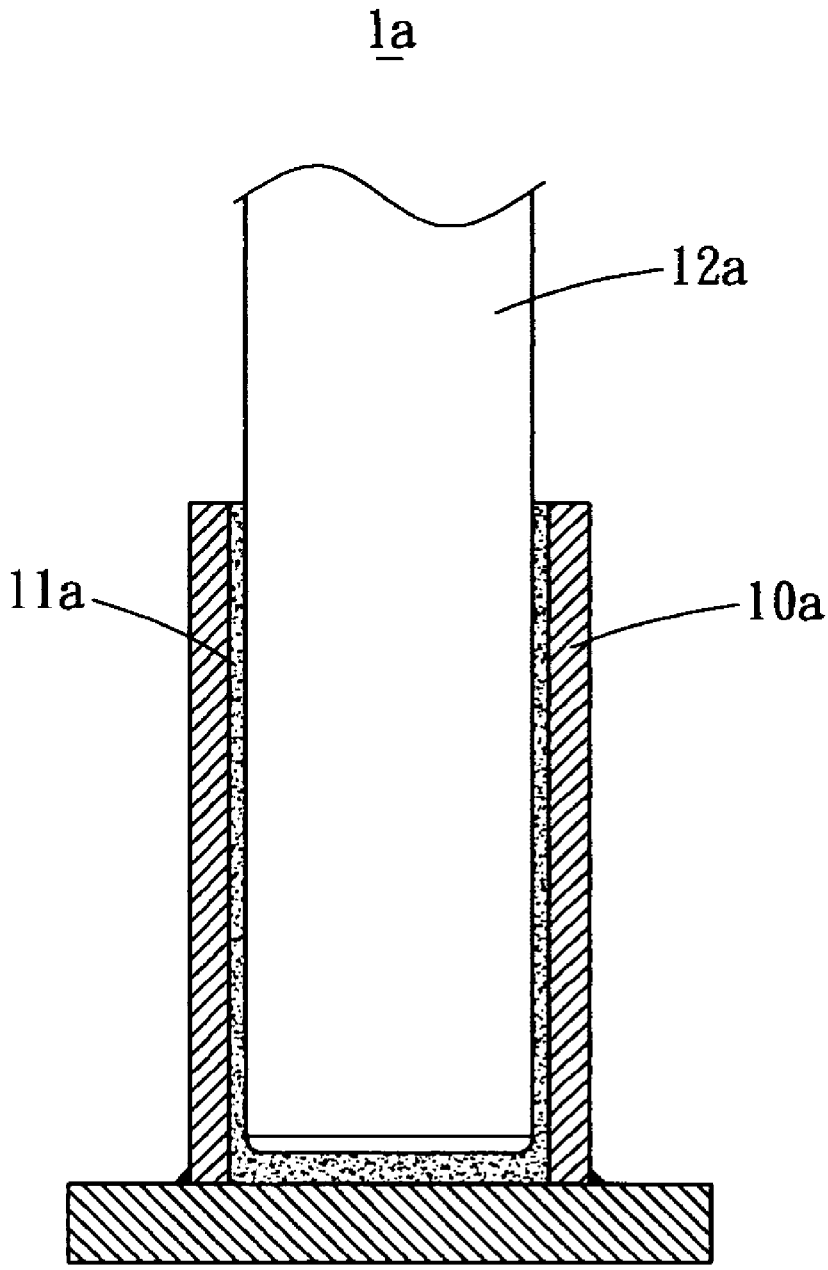
FIG. 1 PRIOR ART
FIG. 1 illustrates a cross sectional view of a conventional heat pipe.
Figure 2:
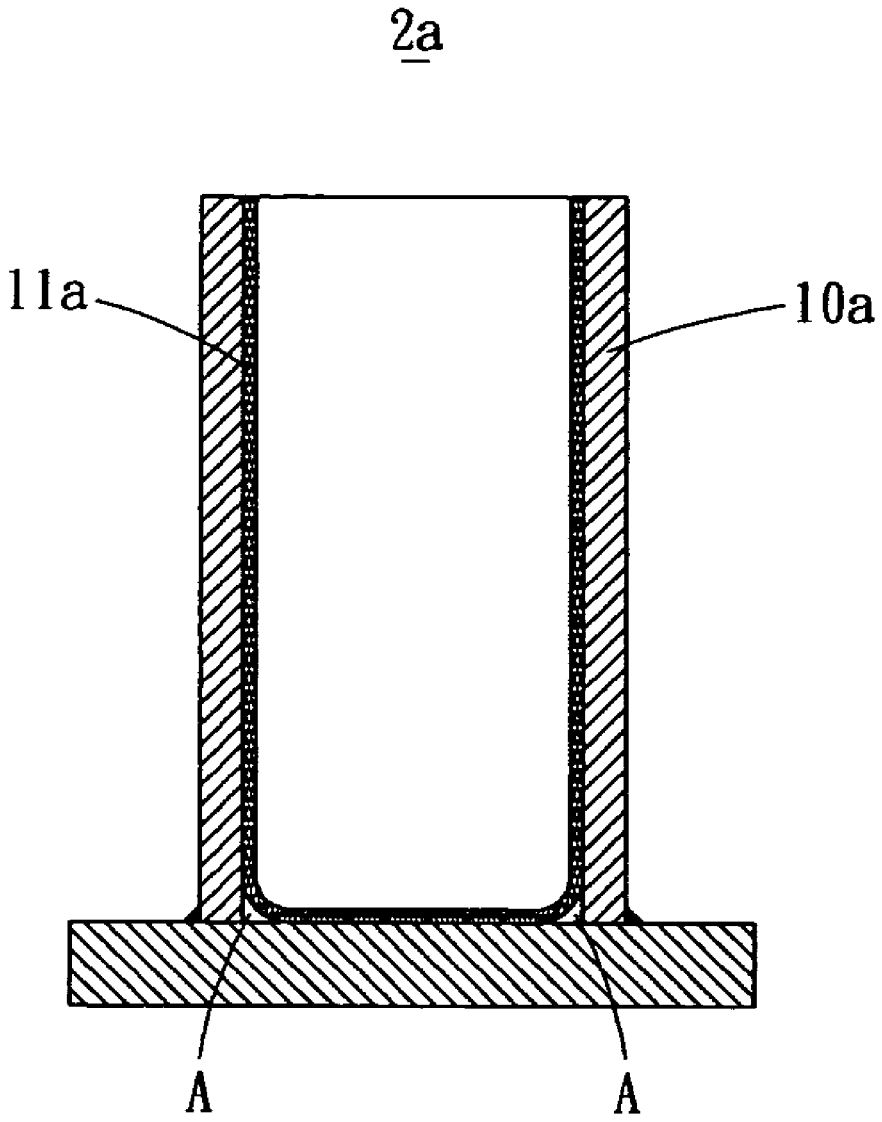
FIG. 2 PRIOR ART
FIG. 2 illustrates a cross sectional view of another conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 3:
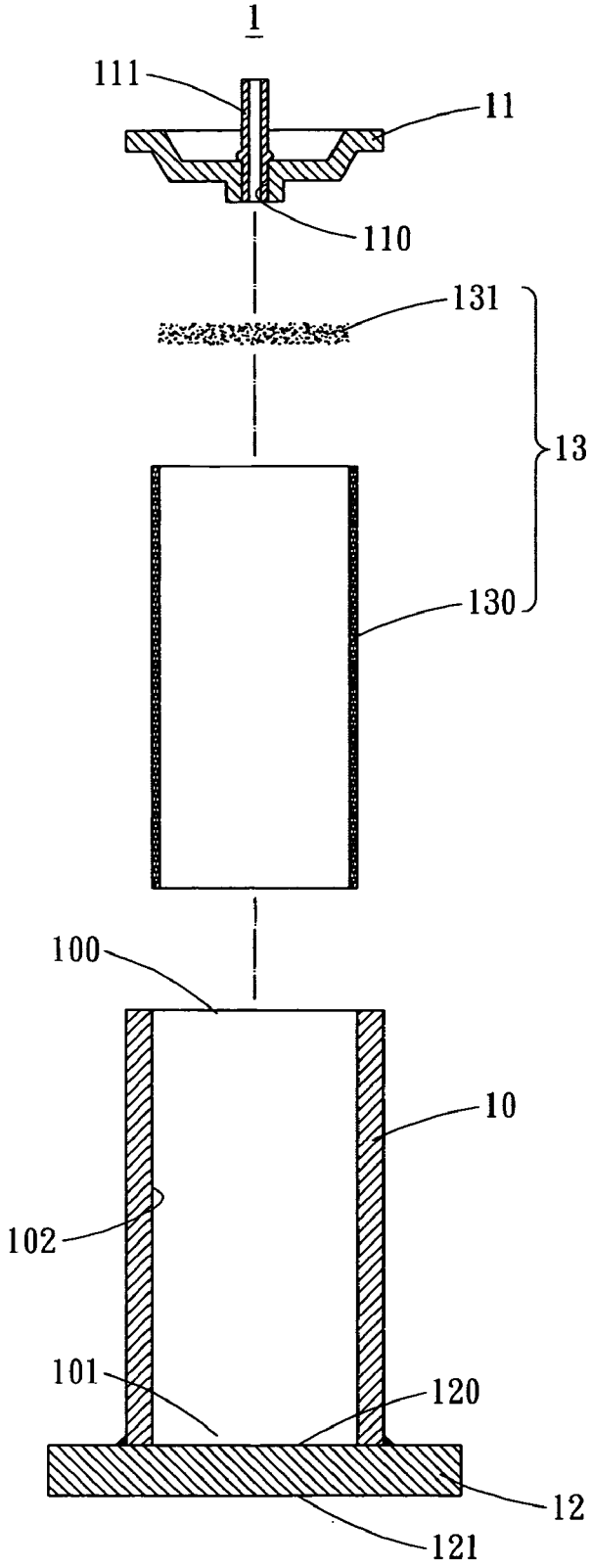
FIG. 3 is an exploded cross sectional view of a heat pipe provided by the present invention.
Figure 4:
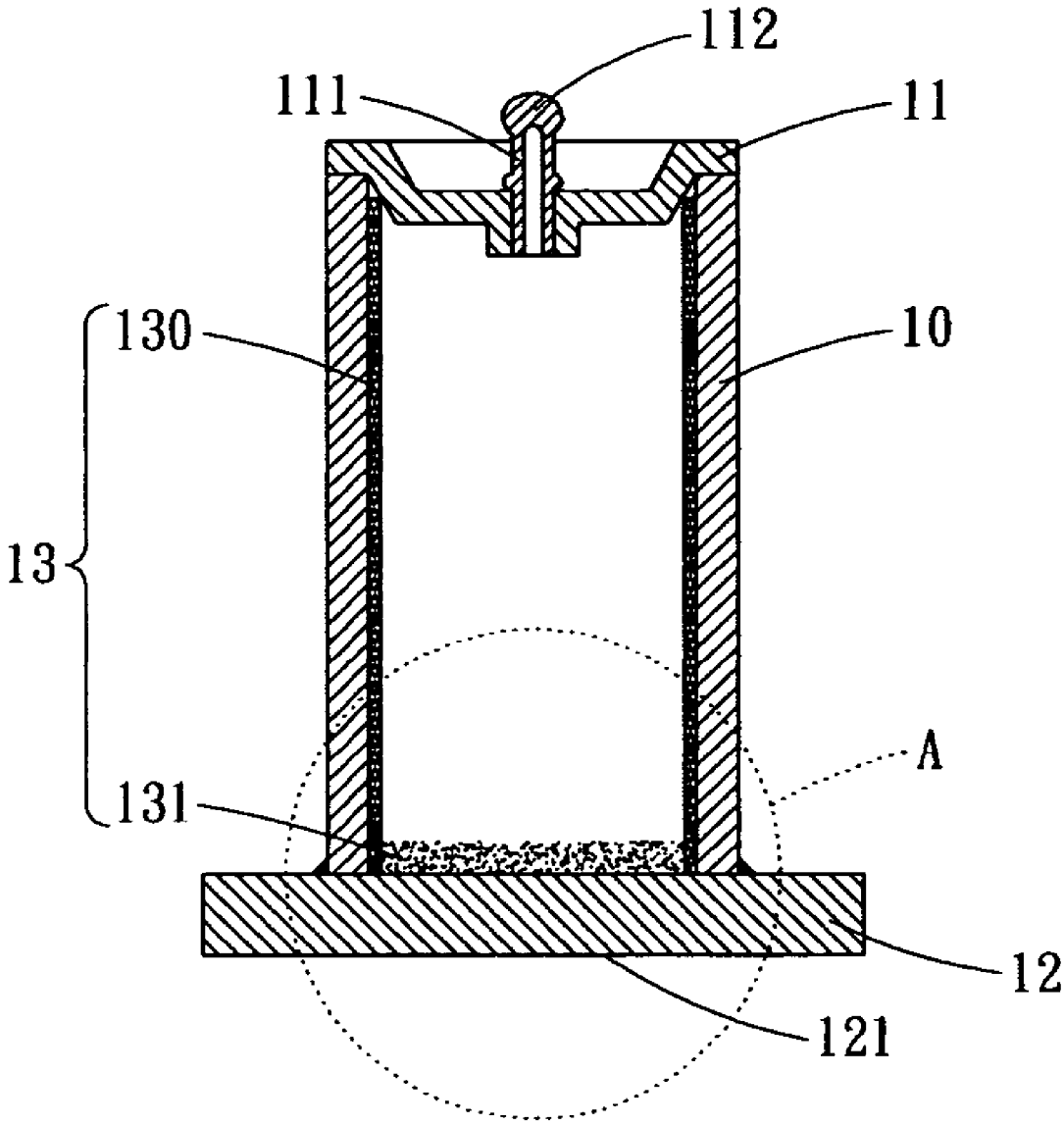
FIG. 4 is a cross sectional view of the heat pipe.

As shown in FIGS. 3 and 4, exploded view and cross sectional view of a heat pipe provided by a first embodiment of the present invention are illustrated. As shown, the heat pipe 1 includes a pipe member 10, a top lid 11 and a bottom lid 12.

The pipe member 10 is preferably a cylindrical hollow tube with an open top end 100 and a bottom end 101 covered by the bottom lid 12. As shown, the pipe member 10 includes a cylindrical interior sidewall 12. The top lid 11 has an aperture 110 for receiving a filling tube 111, such that a working fluid can be filled into the pipe member 10 through the filling tube 111. By subsequent process such as vacuum, the aperture 110 is sealed with the sealing structure 112 formed by tin dipping or soldering. The bottom lid 12 can be formed integrally with the pipe member 10 and the bottom end 101. The bottom lid 12 has an internal end surface 120 and an external surface 121. The external surface 121 is a planar surface to be in contact with a heat-generating source, such that the heat pipe 1 is a end surface absorbing heat pipe.

Figure 5:
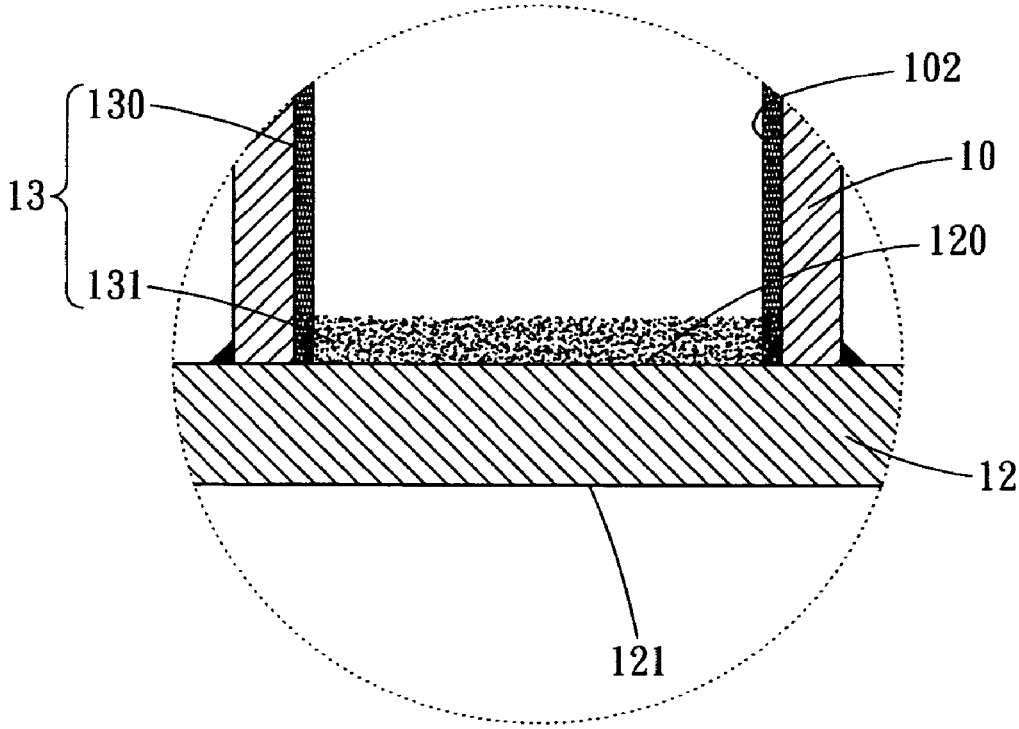
FIG. 5 shows an enlarged view of portion A of the heat pipe.

Referring to FIG. 5, a wick structure 13 is disposed in the pipe member 10 of the heat pipe 1. The wick structure 13 includes at least a woven mesh 130 to be attached to the internal sidewall 102 of the pipe member 10 and sintering powder 131 to be attached to the internal end surface 120 of the bottom lid 120. As woven mesh 130 is in the form of a mesh, and the sintering powder 131 is in the form of particulates, the particulate sintering powder 131 will drive into the porosity of the mesh 130 to integrate the sintering powder 131 with the woven mesh 131 during sintering process. Therefore, capillary and delivery characteristics can be improved. Further, the woven mesh 130 and the sintering powder 131 are attached to the internal sidewall 102 and the internal end surface 120 respectively, such that the wick structure 13 is attached and adhered to the bottom corners of the pipe member 10. The woven mesh 130 can also extend to the internal end surface 120 to increase the contact area with the sintering powder 11; and therefore improve capillary effect and transmission of the heat pipe.

Figure 6:
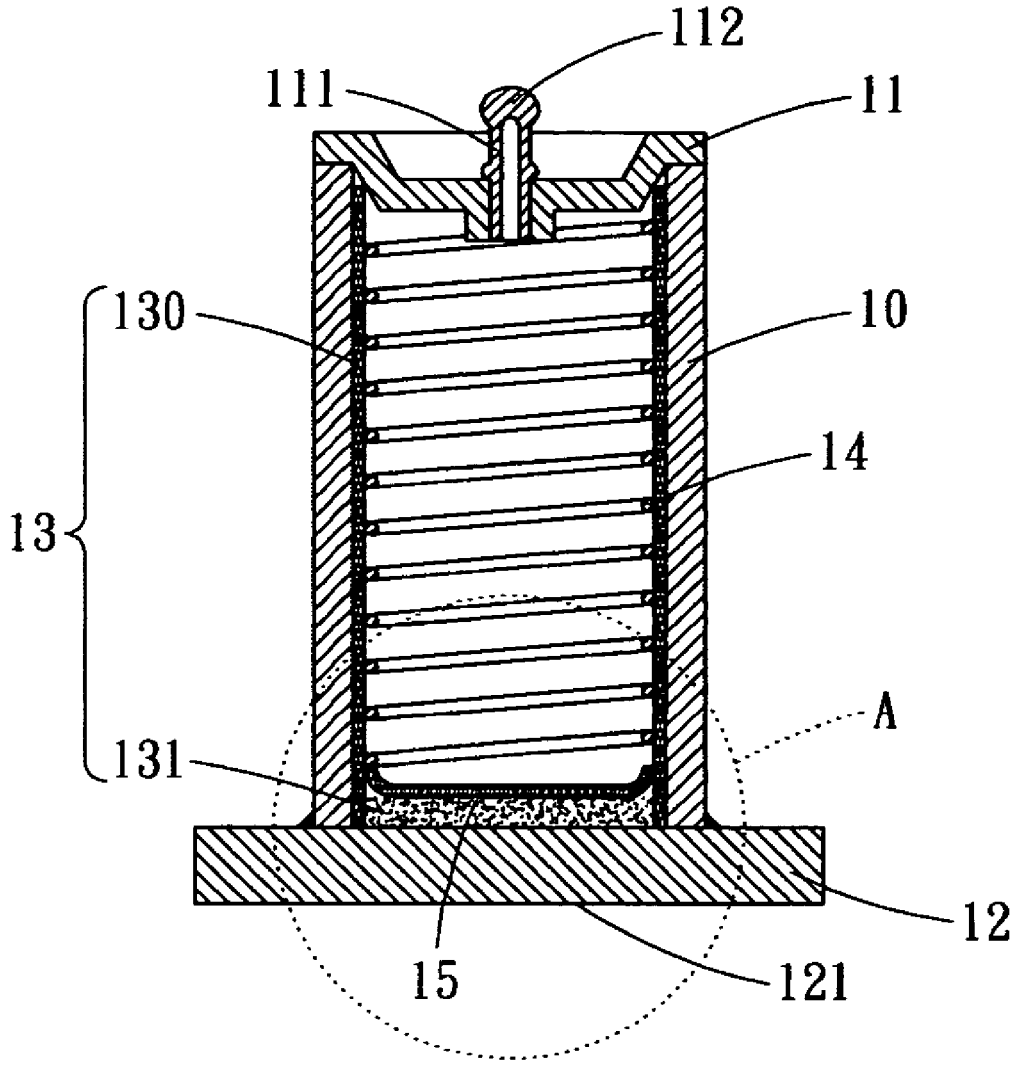
FIG. 6 shows a cross sectional view of a heat pipe in another embodiment of the present invention.
Figure 7:
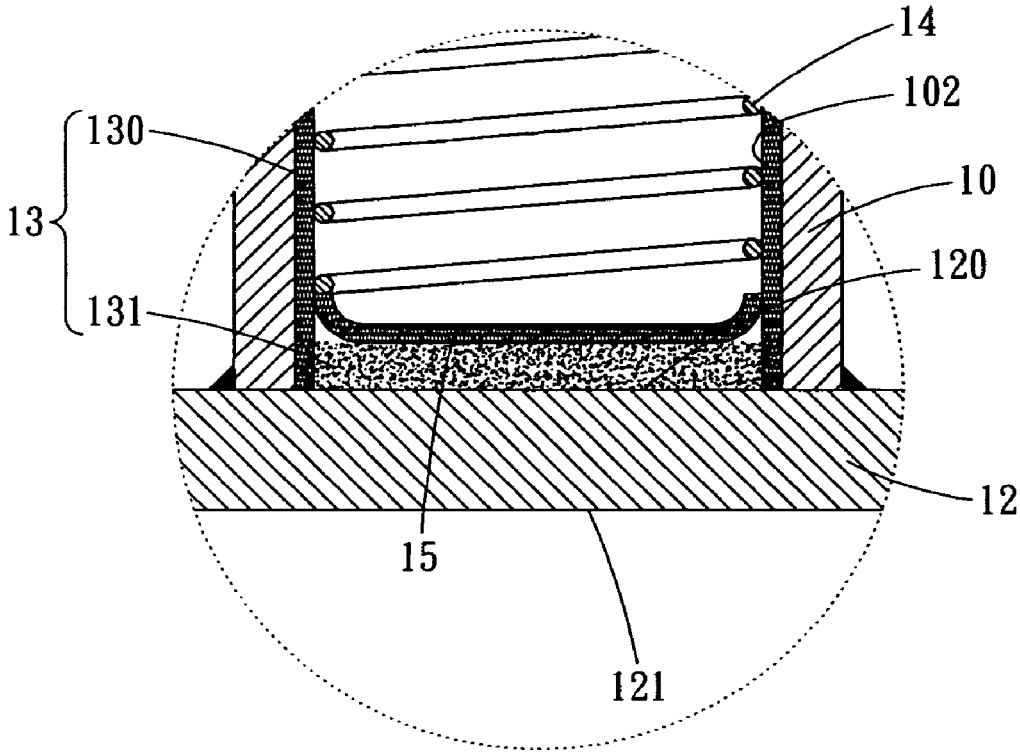
FIG. 7 shows an enlarged view of portion A of FIG. 6.

FIG. 6 shows a cross sectional view of a heat pipe provided by another embodiment of the present invention. The heat pipe 1 includes a support member 14 within the pipe member 10 thereof. The support member 14 includes a planar structure, a linear structure or a porous curled structure. The support member 14 is used to support and press the woven mesh 130 towards the internal sidewall 102 of the pipe member 10 to increase capillary force. As shown in FIG. 7, a press board 15 formed by woven mesh can be installed on the sintering powder 131. Therefore, the pipe member 10 can be oriented horizontally or vertically during sintering process.

Thereby, an end surface capillary structure of a heat pipe is obtained.

The end-surface capillary structure of a heat pipe provided by the present invention has at least the following advantages.

1. The capillary structure does not suffer the drawback of the conventional powder-sintering wick structure. The internal end surface 120 of the pipe member is adhered with the sintering powder 131, and the internal sidewall 102 is covered with the woven mesh 130, such that the axial bar is not required in the sintering process. Therefore, the problem caused by removal of the axial bar does not exist.

2. The advantages of the woven-mesh wick structure are retained. The woven-mesh wick structure does not require an axial bar, such that the wick structure is not easily deformed, and the constant thickness of the wick structure can be maintained. Therefore, it is suitable for mass production, the heat pipe quality and function are more stable, and the cost is reduced.

3. Problems of the conventional woven-mesh wick structure are resolved. The common problem of the woven-mesh wick structure is that the wick structure cannot be properly attached to the bottom corners. However, the sintering powder 131 can be properly attached to the bottom corners.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. An end-surface wick structure of a heat pipe, the heat pipe having a pipe member and a bottom lid covering a bottom end of the pipe member, the wick structure comprising at least a woven mesh attached to an internal sidewall of the pipe member and a sintering powder layer attached to substantially the entire internal surface of the bottom lid, wherein the woven mesh is integrated with the sintering powder at the corner of the bottom.

2. The wick structure as claimed in claim 1, wherein the heat pipe comprises a top lid covering a top end of the pipe member.

3. The wick structure as claimed in claim 2, wherein the heat pipe further comprises a filling tube extending through the top lid.

4. The wick structure as claimed in claim 3, wherein the heat pipe further comprises a sealing structure sealing filling tube.

5. The wick structure as claimed in claim 2, the bottom lid is integrally formed with the pipe member.

6. The wick structure as claimed in claim 1, wherein the bottom lid includes a planar external surface to be in contact with a heat source such that the heat pipe is an end surface absorbing heat pipe.

7. The wick structure as claimed in claim 1, further comprising a support member installed in the pipe member to press the woven mesh towards the internal sidewall.

8. The wick structure as claimed in claim 7, wherein the support member includes a spiral structure.

9. The wick structure as claimed in claim 1, wherein the pipe member includes a press board for pressing the sintering powder layer.

10. The wick structure as claimed in claim 1, wherein the woven mesh extends over the internal end surface.

* * * * *